US007066323B1

(12) United States Patent
Reisman

(10) Patent No.: US 7,066,323 B1
(45) Date of Patent: Jun. 27, 2006

(54) INTERLOCKING PERSONAL BEVERAGE MIXING CONTAINER

(76) Inventor: Lisa M. Reisman, 5580 SW. Nevada Ct., Portland, OR (US) 97219

( * ) Notice: Subject to any disclaimer, the term of this patent is extended or adjusted under 35 U.S.C. 154(b) by 161 days.

(21) Appl. No.: 10/686,453

(22) Filed: Oct. 15, 2003

(51) Int. Cl.
*B65D 23/04* (2006.01)
*B01F 13/00* (2006.01)

(52) U.S. Cl. ..... 206/222; 366/130

(58) Field of Classification Search ..... 206/219, 206/222; 366/130; 222/4.06, 4.07, 4.26, 222/4.27; 220/4.06, 4.07, 4.26, 4.27
See application file for complete search history.

(56) References Cited

U.S. PATENT DOCUMENTS 2,897,994 A * 8/1959 Foss ..... 206/222
3,010,598 A * 11/1961 Foss ..... 206/222
3,404,811 A * 10/1968 Cernei ..... 206/222
4,387,998 A * 6/1983 Szigeti ..... 366/130
4,685,565 A 8/1987 Sparling
5,277,303 A * 1/1994 Goyet et al. ..... 206/219
5,346,082 A * 9/1994 Ochs et al. ..... 215/252

* cited by examiner

*Primary Examiner*—Tony G. Soohoo
(74) *Attorney, Agent, or Firm*—Mark S Hubert

(57) ABSTRACT

An interlocking personal beverage container mixing system that utilizes at least two containers that interconnect such that their fluid contents may be mixed prior to dispensing. The containers, when threadingly engaged irreversibly connect and lock in a leakproof and spill proof fashion. Sanitary seals and safety seals ensure each container in the personal beverage mixing system remains free of foreign contaminants and alerts the purchaser to any tampering.

5 Claims, 12 Drawing Sheets

INTERLOCKING PERSONAL BEVERAGE MIXING CONTAINER

BACKGROUND OF THE INVENTION

The present invention relates to a container adapted to allow interconnection between substantially similar containers such that their fluid contents can be homogeneously mixed prior to consumption.

Juice or vegetable drinks are commonly made by combining several different "base" flavors so as to render a unique taste. The number of flavors used in the combination process is relatively small, however the number of combinations these can provide is much larger. Consider that four "base" juices can be combined to make over ten types of mixed juice. Manufacturers provide many of the popular combinations but not all of the possible combinations so as to minimize distribution and production problems. This means first, that not all people's taste preferences are met, and second, that the vendor must stock a considerable number of different containers. The logical solution would be to provide only the "base" juices and allow the purchaser to mix their own concoctions. Unfortunately, mixing requires both a funnel and a container large enough to hold all the contents, and can be a messy process. This is not well adapted for a consumer on the run.

This new invention allows at least two full beverage containers to be irremovably interconnected so as to form a single drinking container which is capable of vigorous mixing without the possibility of content leakage. In this manner consumers on the go can selectively prepare their preferred concoction without fear of making a mess, and vendors and distributors can provide the widest array of products with the minimum amount of on-hand stock.

SUMMARY OF THE INVENTION

In accordance with the invention, an object of the present invention is to provide an improved leakproof and spill proof beverage mixing system that utilizes only the beverage containers.

It is another object of this invention to provide a beverage mixing system that can accommodate the mixing of more than two types of beverages.

It is a further object of this invention to provide a beverage mixing system that can be tailored for different applications by the simple sizing of the containers.

It is still a further object of this invention to provide a beverage mixing system that is cheap and simple to fabricate and enhances the probability of the return of the empty containers.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 13 a is a top view of an enlarged section of the second lock ring;

DETAILED DESCRIPTION

The preferred embodiment of the interlocking personal beverage mixing container system comprises the threadingly engaged set of at least two interlocking personal beverage mixing containers. The stacked arrangement of beverage containers forms an aesthetically pleasing cylindrical column which can be used after the beverage is consumed to make a play structure or furniture base. Since the cylindrical column of containers is unable to be disassembled it's large size aids to facilitate recycling. Protective and sanitary seals have been incorporated as much as possible to ensure the well being and safety of the consumer.

The material of construction will vary with the desired application. Although it is expected that a synthetic plastic resin beverage container and cap will be used with comestibles, it is possible that glass, metal or alloy containers either, clear, translucent or opaque, may be used with fluids that are corrosive, light sensitive or chemically reactive with synthetic plastic resin. This is not an exhaustive list of materials of construction.

The advantages of this invention as applied to use with beverages reside in the ability for any number of fluids to be mixed together without fear of spilling and without the need for additional containers or tools. Such economy of function is greatly appreciated in this field of art where commonly, mixing requires additional paraphernalia.

Figure 1:
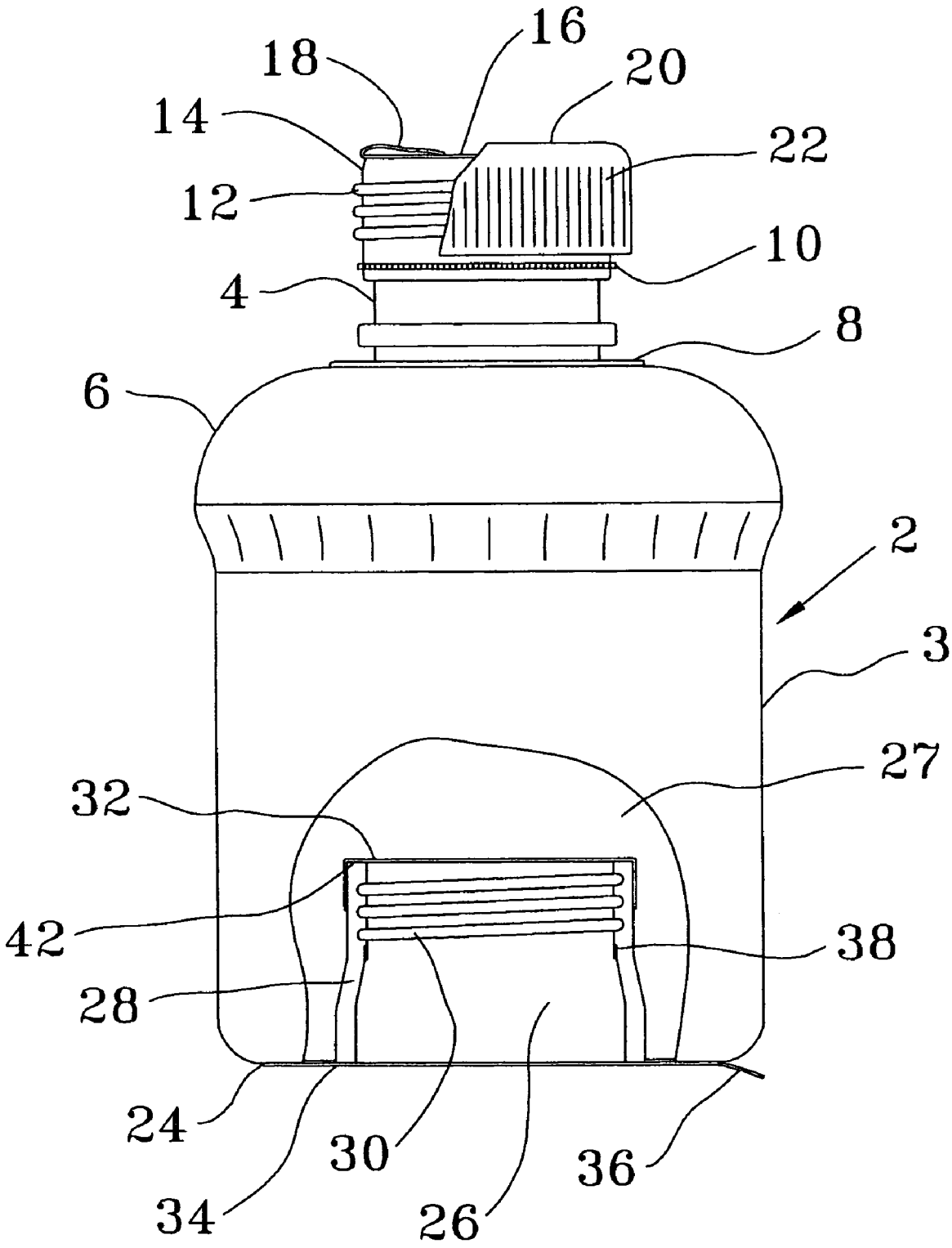
FIG. 1 is a side view of the preferred embodiment beverage mixing container showing cutaway sections of the neck and bottom recess regions.
Figure 11:
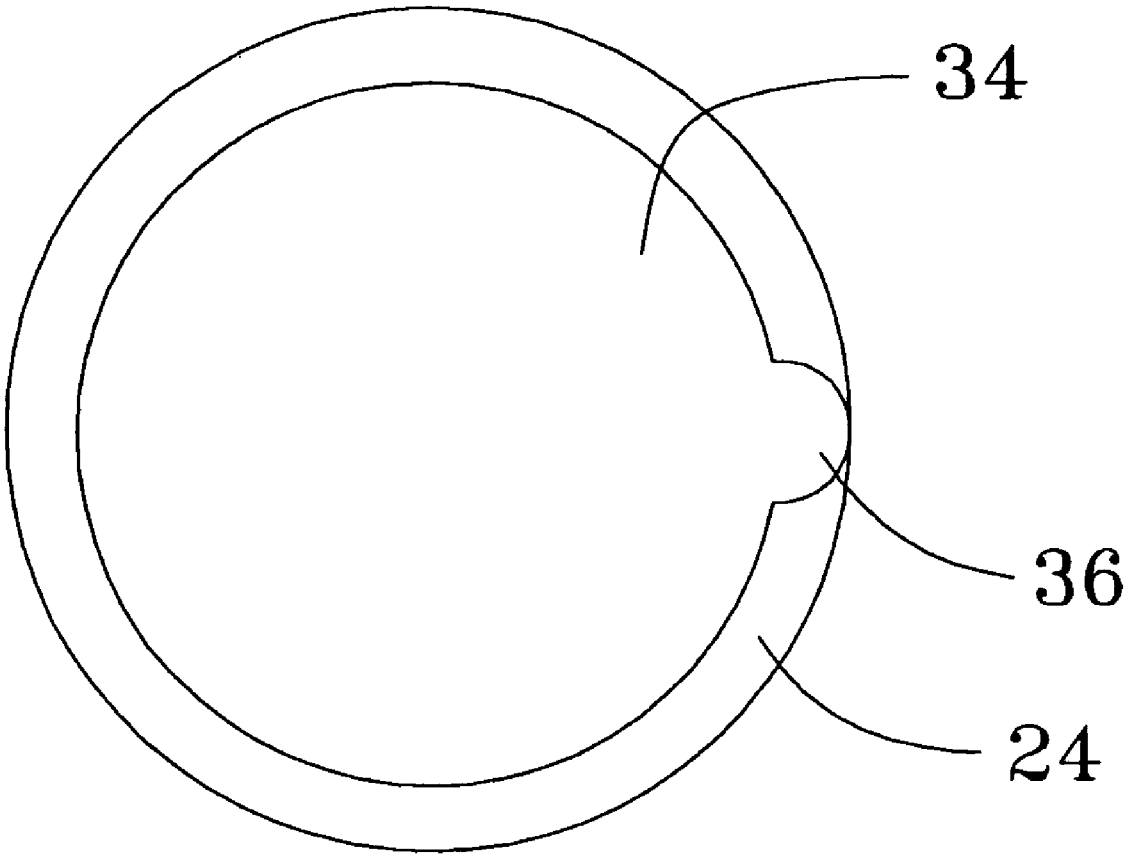
FIG. 11 is a bottom view of a sanitary seal affixed to a container.

Referring to FIG. 1 it can be seen that the preferred embodiment is a container 2 formed by the area enclosed by generally cylindrical wall 3 connected to wide mouth neck 4 by shoulder 6. Gasket 8 encircles neck 4 and resides on shoulder 6 at the region where neck 4 and shoulder 6 meet. Neck 4 has external threads 12 formed on its outer surface 14. First lock ring 10 resides on neck 4 between external threads 12 and gasket 8. First resilient seal 16 is mechanically affixed to neck 4 so as to cover the wide mouth opening (opening not illustrated). A pull tab portion 18 is provided on top seal 16 to facilitate the "tear away" removal of seal 16. Cap 20 has internal threads (not illustrated) adapted to mechanically mesh with external threads 12 on neck 4. Gripable ridges 22 are formed about the outside surface of cap 20. Container bottom 24 has an internal receptacle 26 formed normally thereon and extending upward into container interior 27. Internal receptacle 26 is formed from cylindrical wall 28 and has internal threads 30 formed on the upper region of receptacle 26. Second lock ring 38 is formed on the internal surface of receptacle 26. Cavity Resilient bottom seal 32 is mechanically affixed to top surface 42 of cylindrical wall 28 of internal receptacle 26 so as to cover the receptacle's opening (opening not illustrated). Sanitary seal 34 with sanitary seal pull tab 36 (see FIG. 11) is mechanically affixed to bottom 24. Removal is accomplished by tearing away sanitary seal 34 with sanitary seal pull tab 36.

Figure 2:
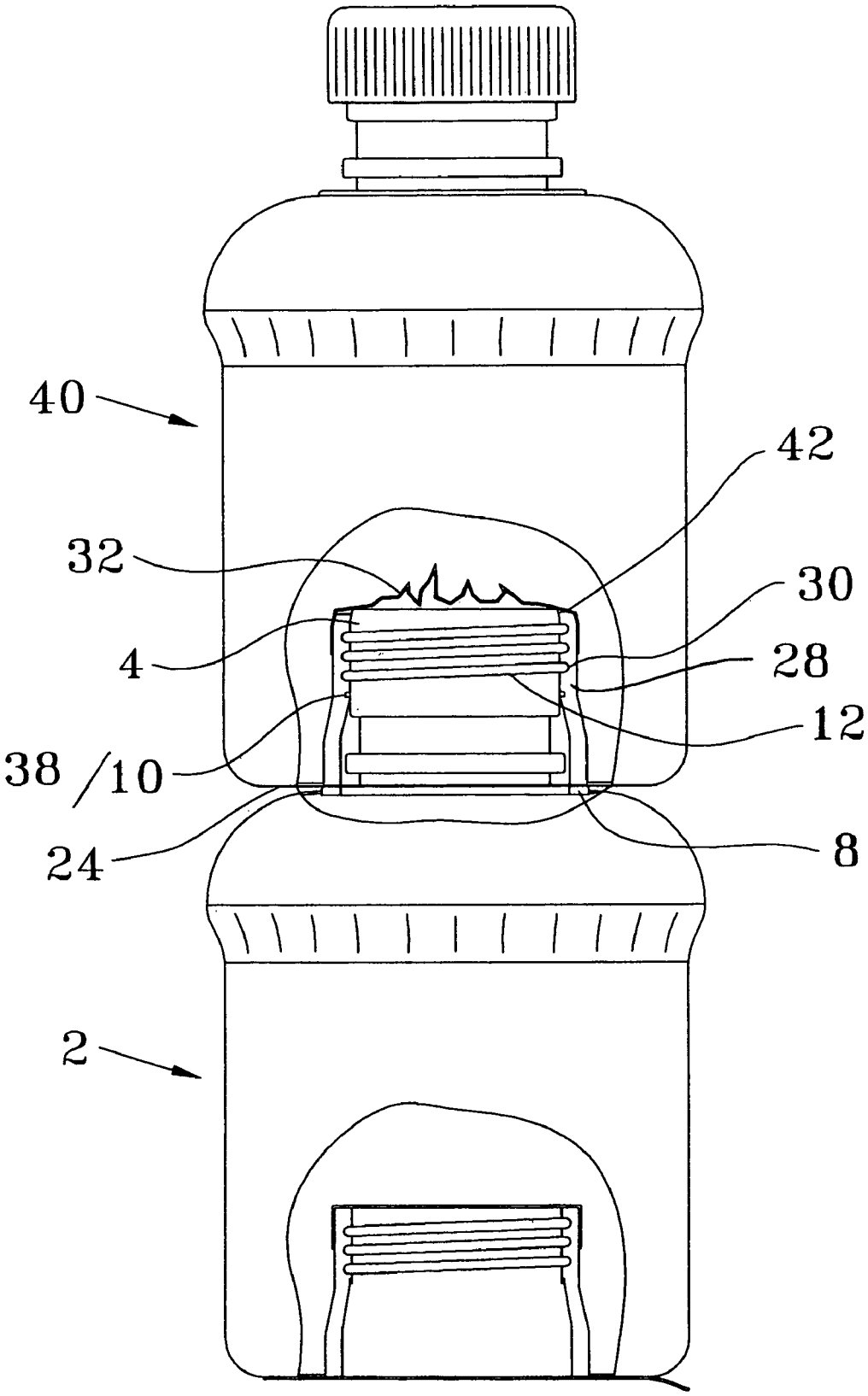
FIG. 2 is a side view of two preferred embodiment beverage mixing containers threadingly engaged, showing cutaway sections of their bottom recess regions.

Referring to FIG. 2 it can be seen that external threads 12 on neck 4 of first preferred embodiment container 2 have been matingly engaged with internal threads 30 on internal receptacle 26 of a substantially similar second preferred embodiment container 40. Neck 4 of second preferred embodiment container 40 extends beyond top surface 42 of cylindrical wall 28. Bottom seal 32 is non elastically deformed and first lock ring 10 is mechanically engaged with second lock ring 38. Gasket 8 of first preferred embodiment container 2 is compressed between shoulder 6 of first preferred embodiment container 2 and container bottom 24 of second preferred embodiment container 40. Top seal 16 of first preferred embodiment container 2 has been removed as has been sanitary seal 34 of second preferred embodiment container 40.

Figure 3:
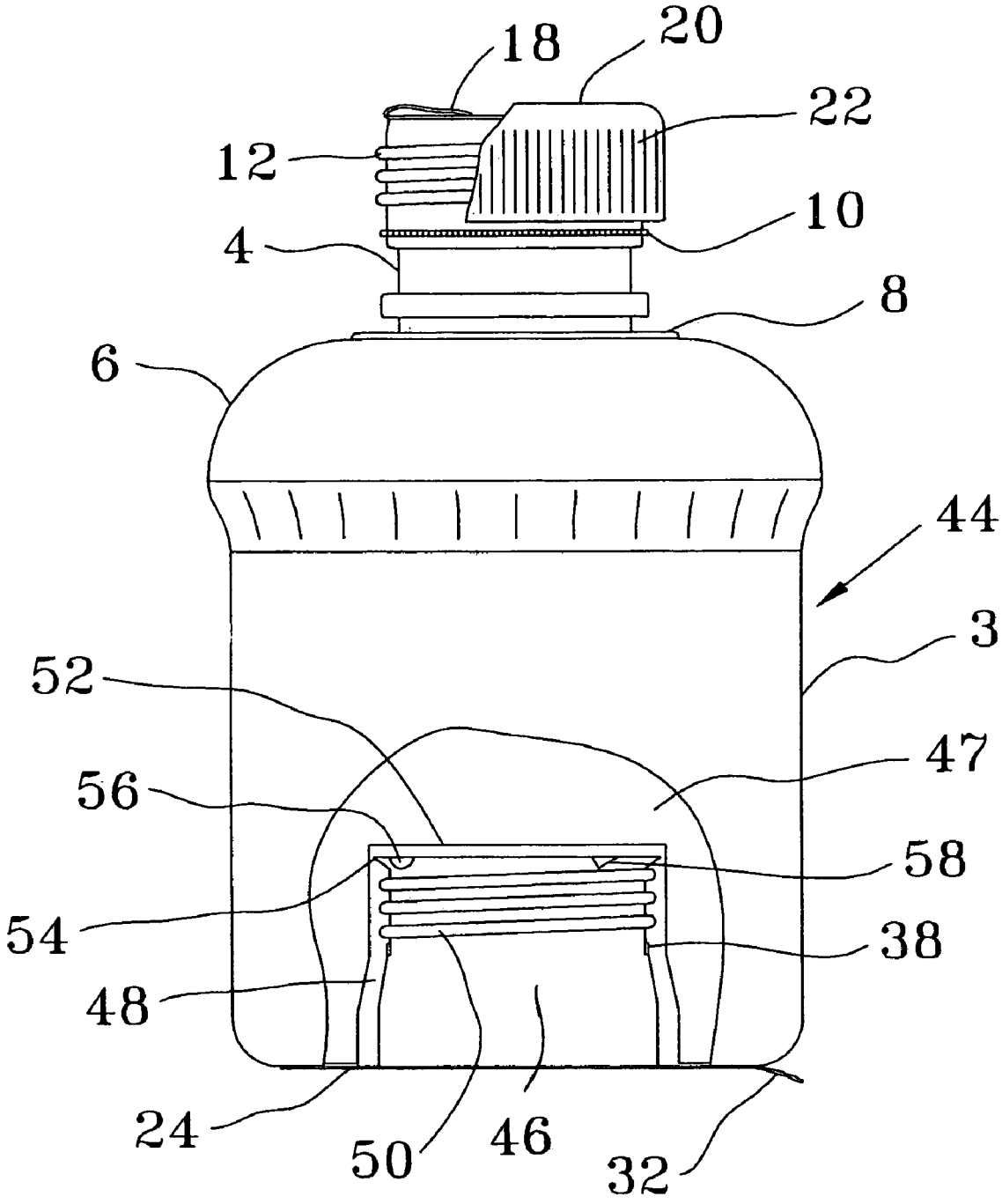
FIG. 3 is a side view of the first alternate embodiment beverage mixing container showing cutaway sections of the neck and bottom recess regions.

Referring to FIG. 3 the first alternate embodiment container 44 can be seen. First alternate embodiment container 44 is substantially similar to preferred embodiment container 2, differing only in the sealing arrangement used on their internal receptacles. First alternate embodiment container 44 is formed by the area enclosed by generally cylindrical wall 3 connected to wide mouth neck 4 by shoulder 6. Gasket 8 encircles neck 4 and resides on shoulder 6 at the region where neck 4 and shoulder 6 meet. Neck 4 has external threads 12 formed on its outer surface 14. First lock ring 10 resides on neck 4 between external threads 12 and gasket 8. First resilient seal 16 is mechanically affixed to neck 4 so as to cover the wide mouth opening (opening not illustrated). A pull tab portion 18 is provided on top seal 16 to facilitate the "tear away" removal of seal 16. Cap 20 has internal threads (not illustrated) adapted to mechanically mesh with external threads 12 on neck 4. Gripable ridges 22 are formed about the outside surface of cap 20. Container bottom 24 has a second internal receptacle 46 formed normally thereon and extending upward into first alternate embodiment container interior 47. Second internal receptacle 46 is formed from second cylindrical wall 48 and has internal threads 50 formed on the upper region of the receptacle 46. Second lock ring 38 is formed on the internal surface of receptacle 46. Hard disk 52 is mechanically attached to second cylindrical wall 48 so as to cover the receptacle's opening (opening not illustrated). Score 54 is a continuous circular notch that resides at the intersection of hard disk 52 and second cylindrical wall 48. Opening nodule 56 and seal cutter 58 are formed on planar face 55 (see FIG. 4) of disk 52. Thinned wall section 53 connects disk 52 to second cylindrical wall 48. Sanitary seal 34 with sanitary seal pull tab 36 is mechanically affixed to bottom 24.

Figure 4:
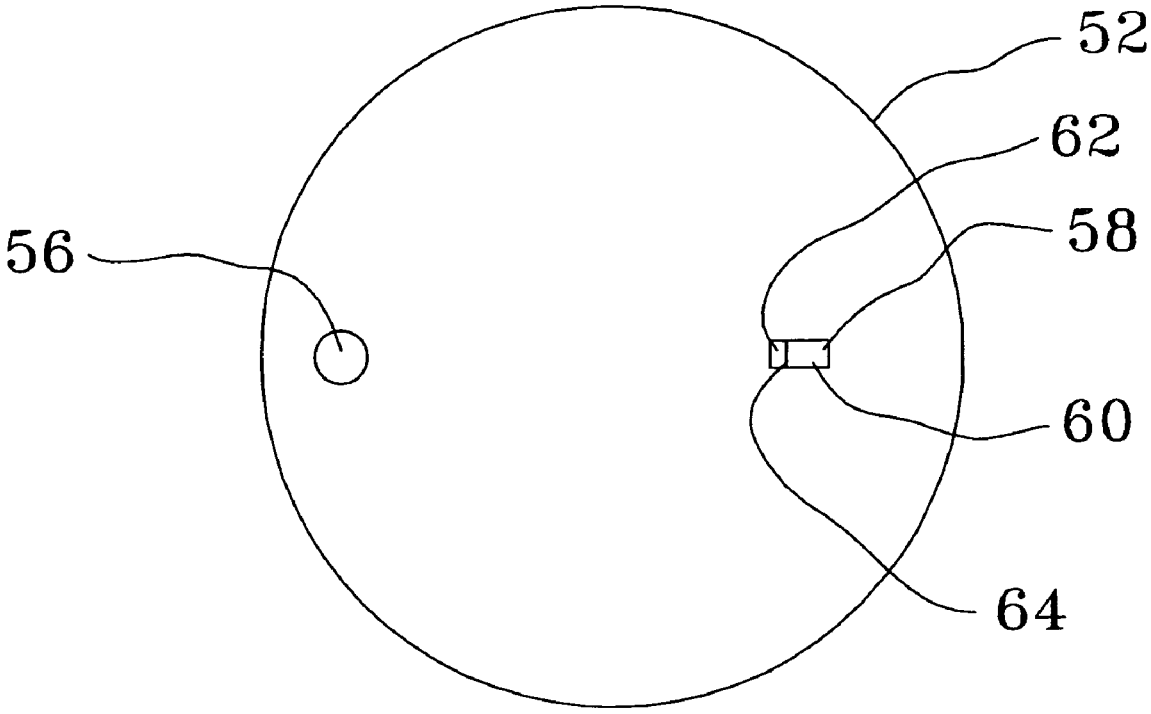
FIG. 4 is a top view of the first alternate embodiment beverage mixing container disk.
Figure 5:
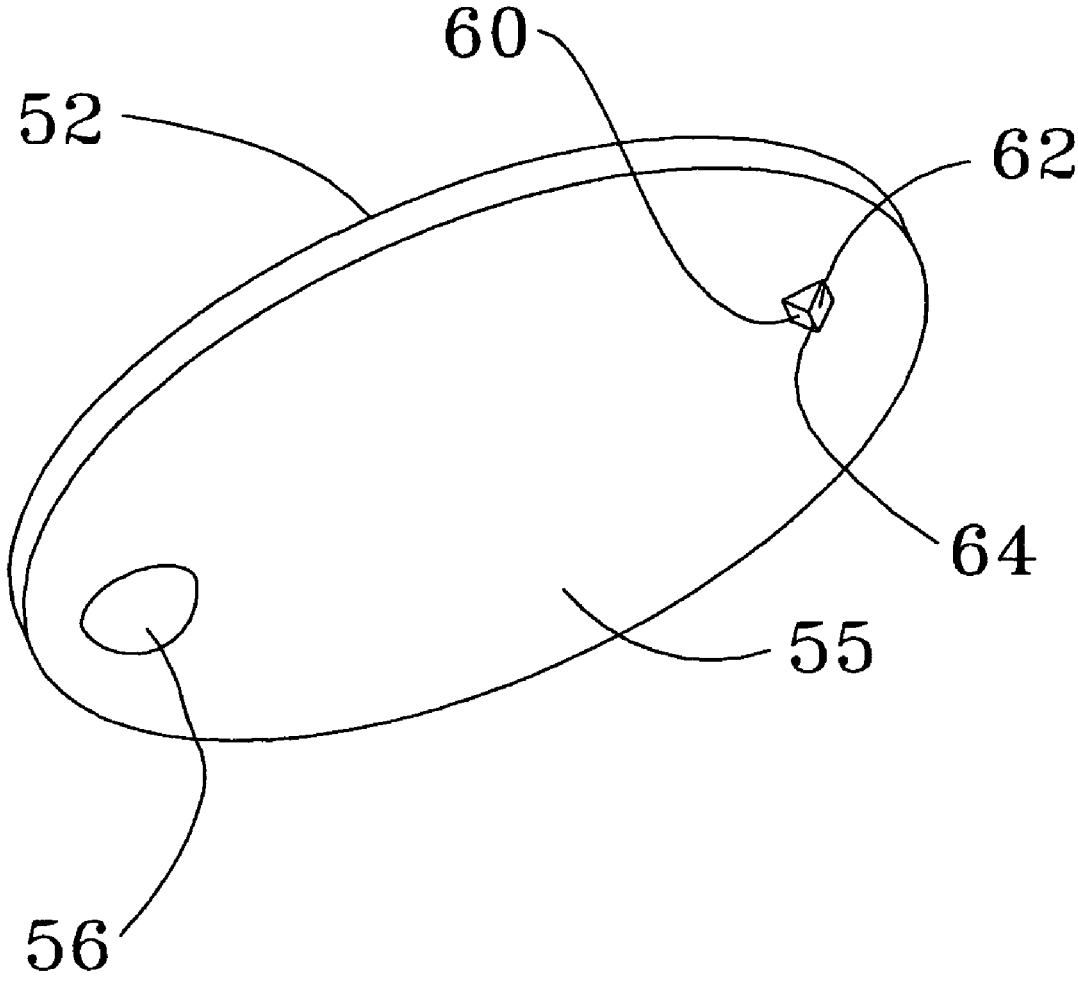
FIG. 5 is a tilted perspective view of the first alternate embodiment beverage mixing container disk.

FIGS. 4 and 5 illustrate how hemispherical opening nodule 56 and seal cutter 58 are formed on planar face 55 of disk 52. Seal cutter 58 is configured in a "vee" formation having a first side 60 and a second side 62 formed normal to each other so as to create sharp 64 that protrudes from planar face 55.

Figure 6:
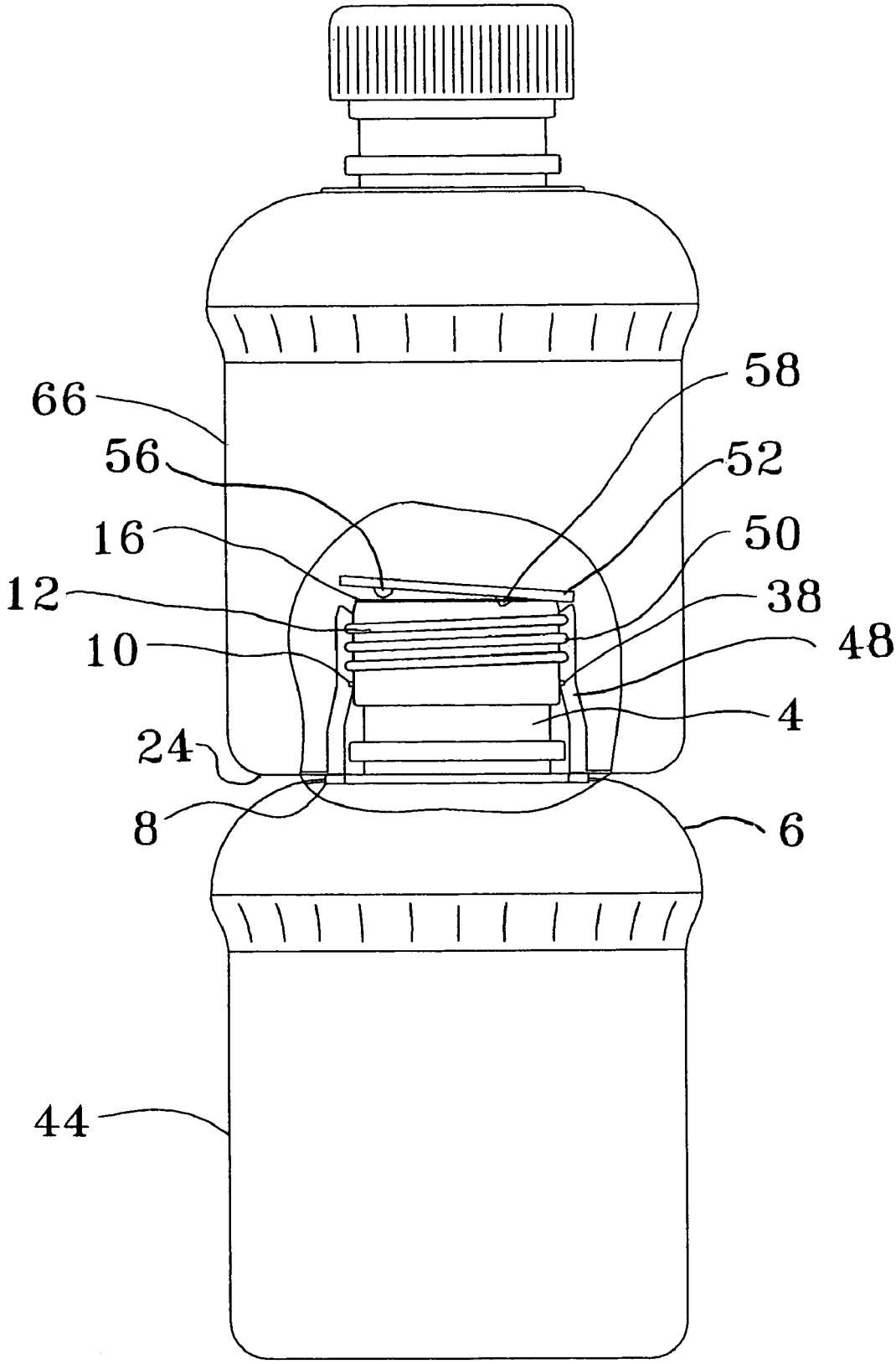
FIG. 6 is a side view of two first alternate embodiment beverage mixing containers threadingly engaged, showing a cutaway section of the bottom recess region of the top container.
Figure 8:
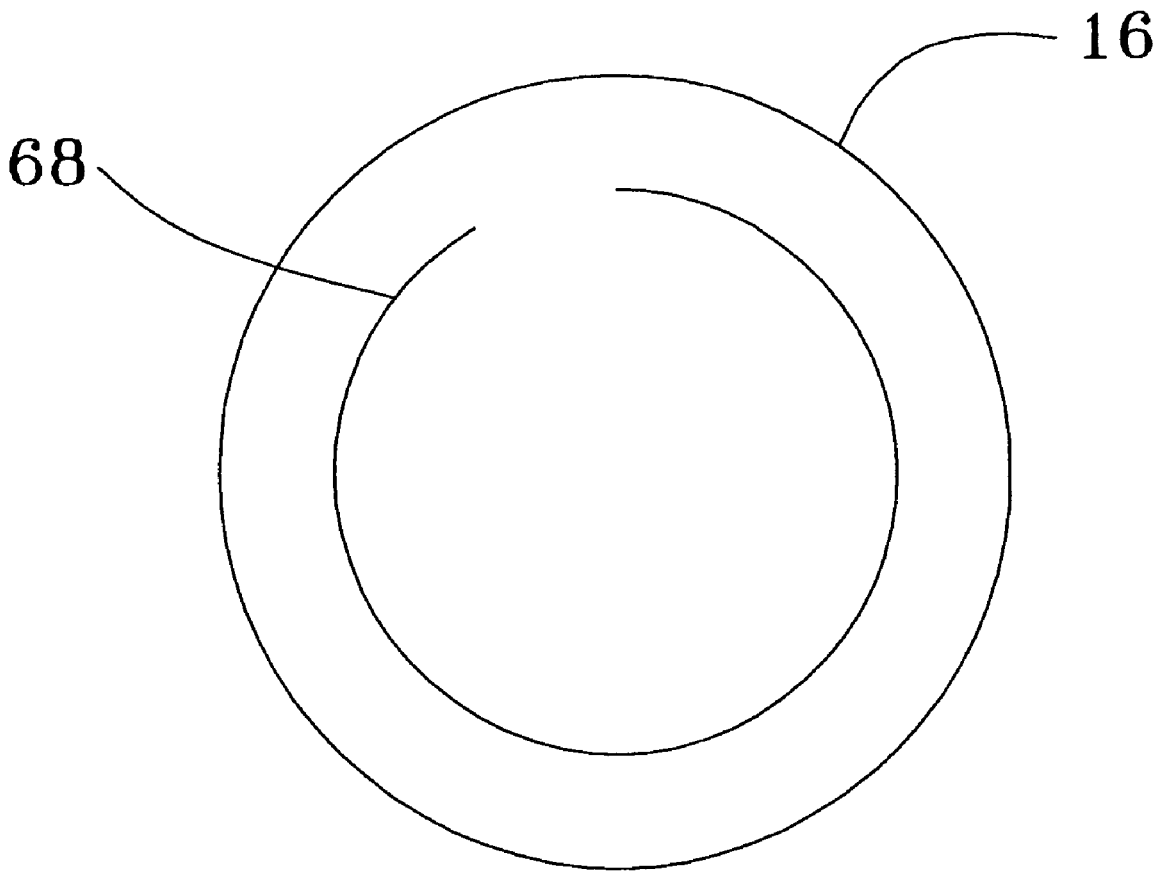
FIG. 8 is a top view of a circular cut dispensing seal of the second alternate embodiment beverage mixing container.

Referring to FIG. 6 it can be seen that external threads 12 on neck 4 of first alternate embodiment container 44 have been matingly engaged with second internal threads 50 on second internal receptacle 46 of a substantially-similar first alternate embodiment second container 66. Neck 4 of first alternate embodiment container 44 is in contact with opening nodule 56 of disk 52 and sharp 64 of seal cutter 58 (see FIG. 5) is in contact with top seal 16. Disk 52 is partially removed from second cylindrical wall 48 along score 54 (see FIG. 3). Gasket 8 of first alternate embodiment container 40 is compressed between shoulder 6 of first alternate embodiment container 44 and container bottom 24 of first alternate embodiment second container 66. Top seal 16 of first alternate embodiment container 40 has a partial circular arc 68 (see FIG. 8) scribed through it. Sanitary seal 34 of first alternate embodiment second container 66 has been removed. First lock ring 10 is mechanically engaged with second lock ring 38.

Figure 7:
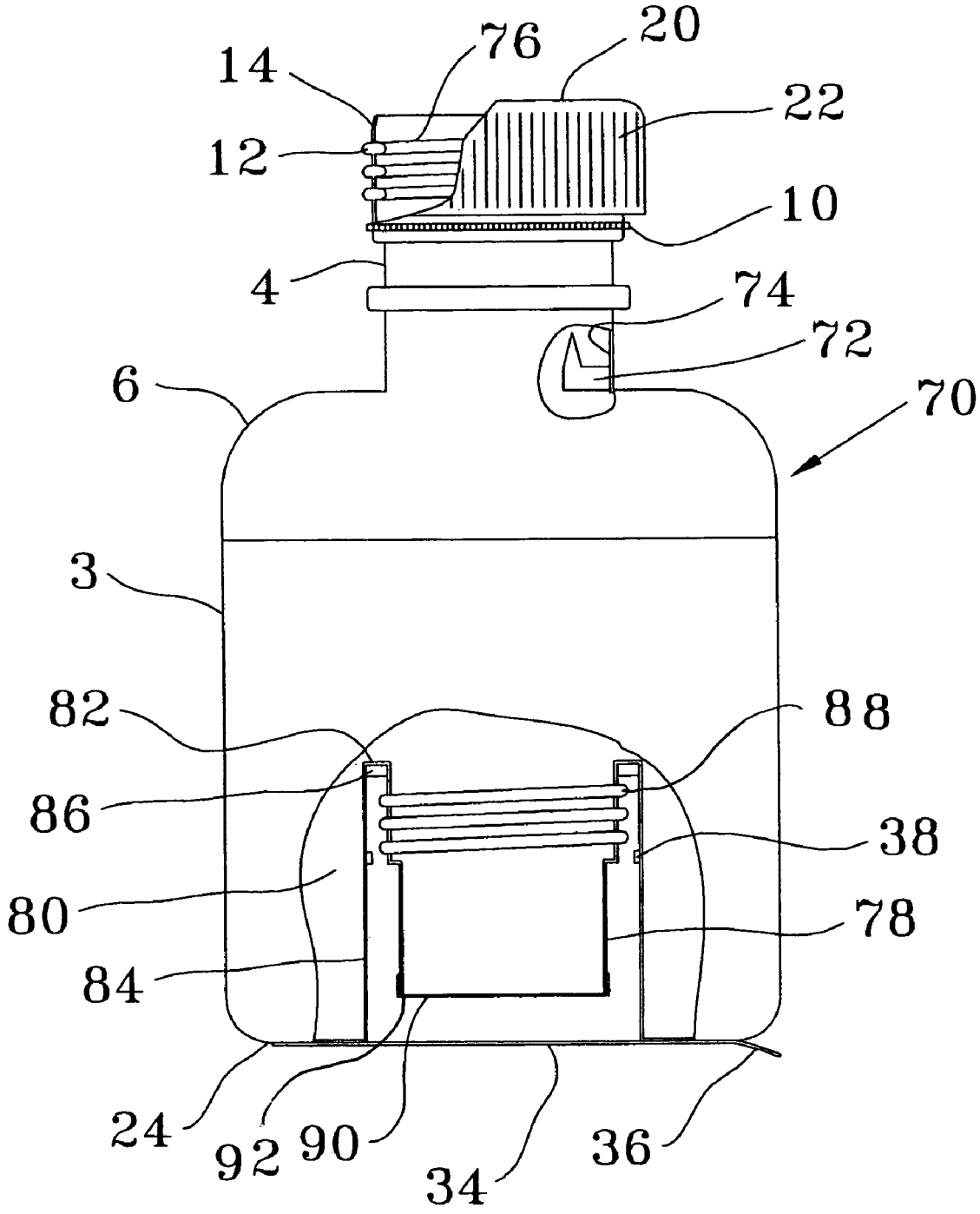
FIG. 7 is a side view of the second alternate embodiment beverage mixing container showing cutaway sections at the neck, shoulder and bottom recess regions.

FIG. 7 illustrates the second alternate embodiment container 70. Second alternate embodiment container 70 has several features that distinguish it from preferred embodiment container 2, and first alternate embodiment container 40. Second alternate embodiment container 70 is formed by the area enclosed by generally cylindrical wall 3 connected to wide mouth neck 4 by shoulder 6. Opening spike 72 resides on the inner surface 74 of neck 4 where neck 4 and shoulder 6 meet. Neck 4 has external threads 12 formed on its outer surface 14 and internal threads 76 formed on it's inner surface 74. First lock ring 10 resides on neck 4 below external threads 12. Cap 20 has internal threads (not illustrated) adapted to mechanically mesh with external threads 12 on neck 4. Gripable ridges 22 are formed about the outside surface of cap 20. Container bottom 24 has cylinder 84 formed normally thereon and extending upward into second alternate embodiment container interior 80. Shoulder 82 projects inward from the top of cylinder 84. Third internal receptacle 78 extends downward from shoulder 82 and forms a concentric cylinder spaced equidistantly within cylinder 84. Second locking ring 38 is formed on third internal receptacle 78. Second external threads 88 are formed on third internal receptacle 78. On Shoulder 82 between cylinder 84 and third internal receptacle 78 seal ring 86 is mechanically affixed. Second bottom seal 90 is mechanically affixed to bottom surface 92 of third internal receptacle 78 so as to cover the receptacle's opening (opening not illustrated). Sanitary seal 34 with sanitary seal pull tab 36 is mechanically affixed to bottom 24.

Figure 9:
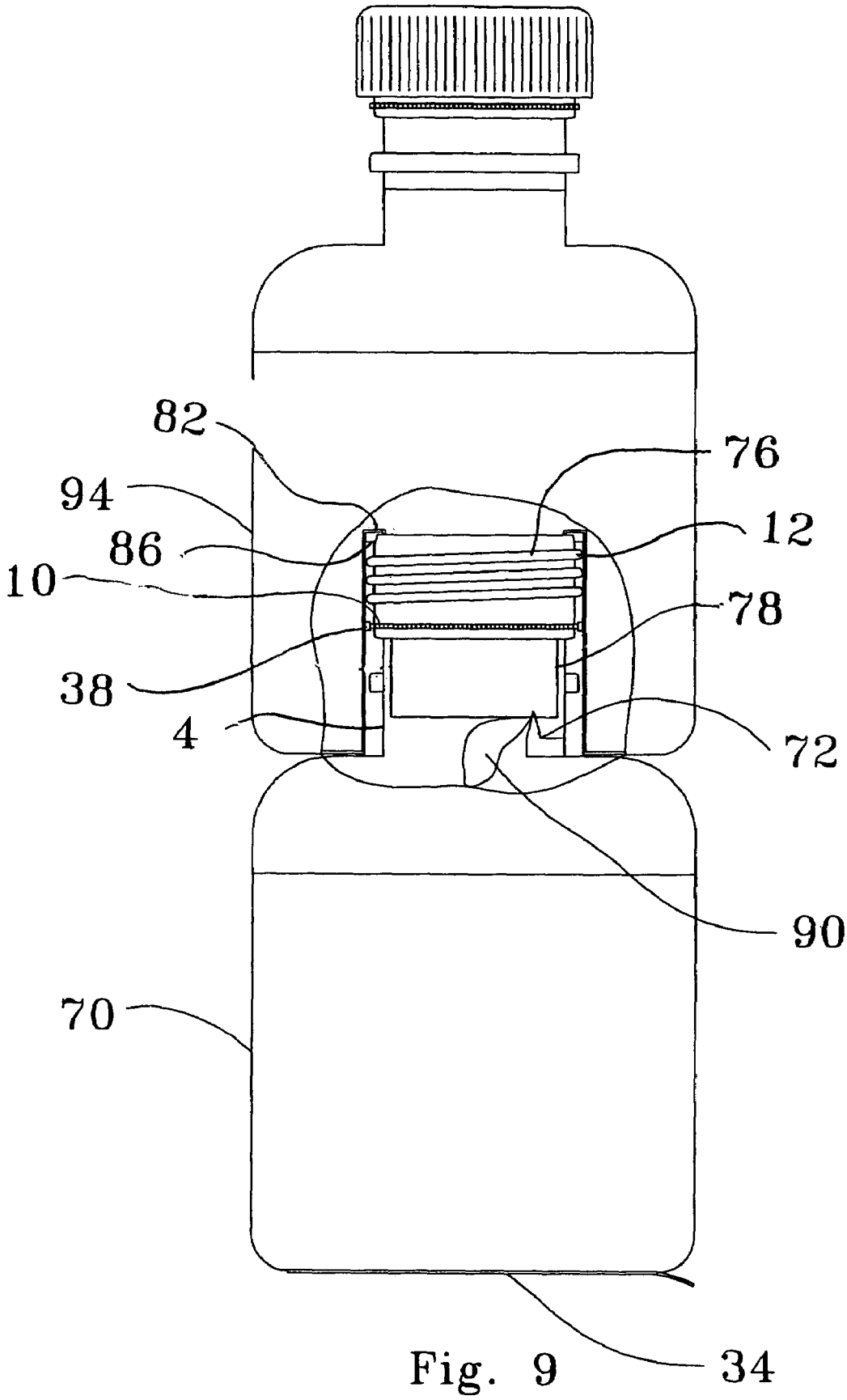
FIG. 9 is a side view of two second alternate embodiment beverage mixing containers threadingly engaged, showing a cutaway section of the bottom recess region.
Figure 10:
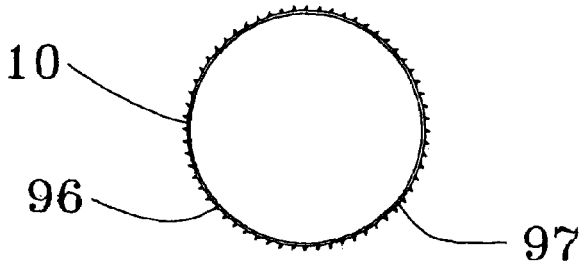
FIG. 10 is a top view of the first lock ring.
Figure 10A:
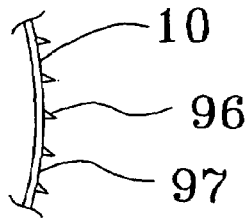
FIG. 10*a* is a top view of an enlarged section of the first lock ring.
Figure 13:
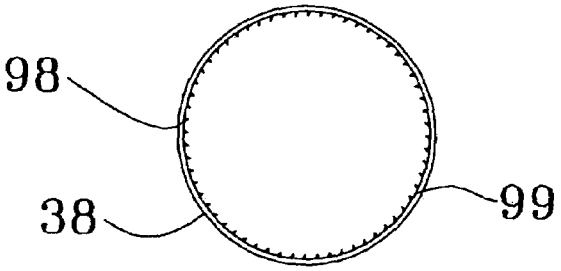
FIG. 13 is a top view of the second lock ring.
Figure 13A:
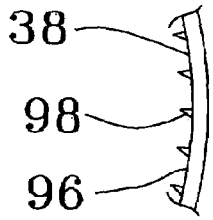
Figure 14:
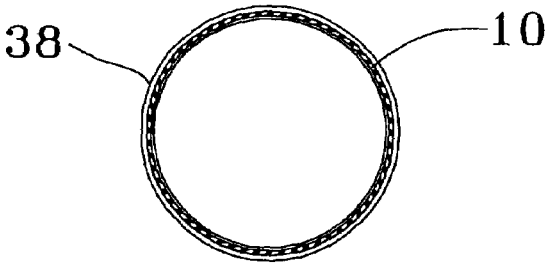
FIG. 14 is a top view of the lock rings engaged.
Figure 14A:
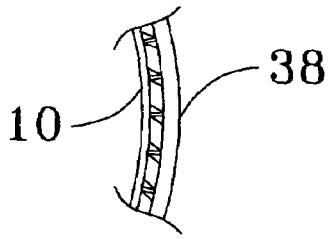
FIG. 14*a* is a top view of an enlarged section of the engaged lock rings.

FIG. 9 illustrates second alternate embodiment container 70 engaged with second alternate embodiment second container 94. Internal threads 76 are matingly engaged with external threads 12. Third internal receptacle 78 of second alternate embodiment second container 94 extends down neck 4 of second alternate embodiment container 70. Opening spike 72 is in contact with second bottom seal 90 which has a partial circular cut made in it in a similar fashion to that of arc 68 in top seal 16 (see FIG. 8). Bottom seal 90 extends into second alternate embodiment container 70. Sanitary seal 34 of first alternate embodiment second container 66 has been removed. First lock ring 10 is mechanically engaged with second lock ring 3 8. Seal ring 86 is compressed between shoulder 82 and neck 4.

Operation of the interlocking personal beverage mixing container system using two substantially similar containers of each of the three container embodiments is described below.

Referring again to FIG. 2 will help to explain operation of the of the interlocking personal beverage mixing container system utilizing the preferred embodiment container 2. Sanitary seal 34 is removed from the first preferred embodiment container 2 by pulling tab 36. Cap 20 is unscrewed from the second preferred embodiment container 40 and top seal 16 is removed by pulling tab 18. Neck 4 of container 2 is inserted into receptacle 26 of container 40 and the containers are twisted in opposite directions relative to each other so as to engage external threads 12 of container 2 and internal threads 30 of container 40. As container 2 rises up inside container 4, neck 2 contacts bottom seal 32 and deforms seal 32 until it is torn, thereby allowing fluid to transfer easily between the two containers through the wide mouth of neck 4. Just prior to the tearing of bottom seal 32, gasket 8 is compressed between shoulder 6 of container 2 and bottom 24 of container 40 to form a fluid tight seal. At approximately the same relative position of the two containers, first lock ring 10 engages second lock ring 38 to prevent disengagement of the containers by reversing the direction of rotation.

Referring to FIG. 6 will similarly aid to explain operation of the interlocking personal beverage mixing container system using the first alternate embodiment container. Sanitary seal 34 is removed from the first alternate embodiment second container 66 by pulling tab 36. Cap 20 is unscrewed from the first alternate embodiment container 44. The top seal 16 is not removed. Neck 4 of container 44 is inserted into second internal receptacle 46 of container 66 and the containers are twisted in opposite directions relative to each other so as to engage external threads 12 of container 44 and internal threads 30 of container 66. As container 44 rises up inside container 66, neck 2 contacts opening nodule 56 of hard disk 52 and top seal 16 contacts seal cutter 58. The torque developed while threadingly engaging the containers exerts an upward point force on hard disk 52 at opening nodule 56. This causes disk 52 to tear away from second cylindrical wall 48 at score 54 at a location proximate to opening nodule 56. Disk 52 continues to tear away along score 54 as neck 4 of container 66 rises by the continued threaded engagement of the containers. At the same time, sharp 64 of seal cutter 58 scribes partial circular arc 68 in top seal 16, allowing fluid to transfer between the containers easily via the wide mouth design of neck 4. Just prior to the tearing of hard disk 52 and cutting of top seal 16, gasket 8 is compressed between shoulder 6 of container 66 and bottom 24 of container 44 to form a fluid tight seal. At approximately the same relative position of the two containers, first lock ring 10 engages second lock ring 38 to prevent disengagement of the containers by reversing the direction of rotation.

The use of the seal cutter 58 and top seal 16 is not necessary but serves to provide additional sterility and safety.

Referring to FIG. 9 will help to explain operation of the of the interlocking personal beverage mixing container system utilizing the second alternate embodiment container 70. Sanitary seal 34 is removed from the first preferred embodiment container 70 by pulling tab 36. Cap 20 is unscrewed from the second preferred embodiment second container 94 and top seal 16 is removed by pulling tab 18. Neck 4 of container 94 is inserted into receptacle third internal receptacle 78 of container 94 and the containers are twisted in opposite directions relative to each other so as to engage internal threads 76 of container 70 and second external threads 88 of container 94. As container 2 rises up inside container 94 neck 2 contacts seal ring 86 and compresses it against shoulder 82 so as to form a leakproof seal. At approximately the same relative position of the containers, two events occur. First, first lock ring 10 engages second lock ring 38 to prevent disengagement of the containers by reversing the direction of rotation. Second, opening spike 72 contacts second bottom seal 90 and cuts a partial arc in seal 90 similar to the partial circular arc 68 cut top seal 16 by seal cutter 58 in the first alternate embodiment. This allows fluid to transfer between the containers.

Although this second alternate embodiment uses a seal ring 86, because the third internal receptacle fits inside of neck 4, leakage when twisting the containers together is unlikely.

Referring to FIGS. 10, 10*a*, 13, 13*a*, 14 and 14*a* the design and operation of first lock ring 10 and second lock ring 38 are best illustrated. First lock ring 10 is a circular ring that has first beveled teeth 96 about it's outer periphery 97. Second lock ring 38 is a circular ring that has second beveled teeth 98 about it's inner periphery 99. First beveled teeth 96 and second beveled teeth 98 are mirror images of each other. The outer diameter of first lock ring 10 and the inner diameter of second lock ring 38 are sized so as to allow the corresponding mating of their teeth. The rings are made from a resilient yet flexible plastic polymer so as to allow the angled tips of the teeth to flex enough to facilitate locking of the rings when the containers are being engaged. The angled design of the teeth will not allow flex for the purpose of disengagement.

Figure 12:
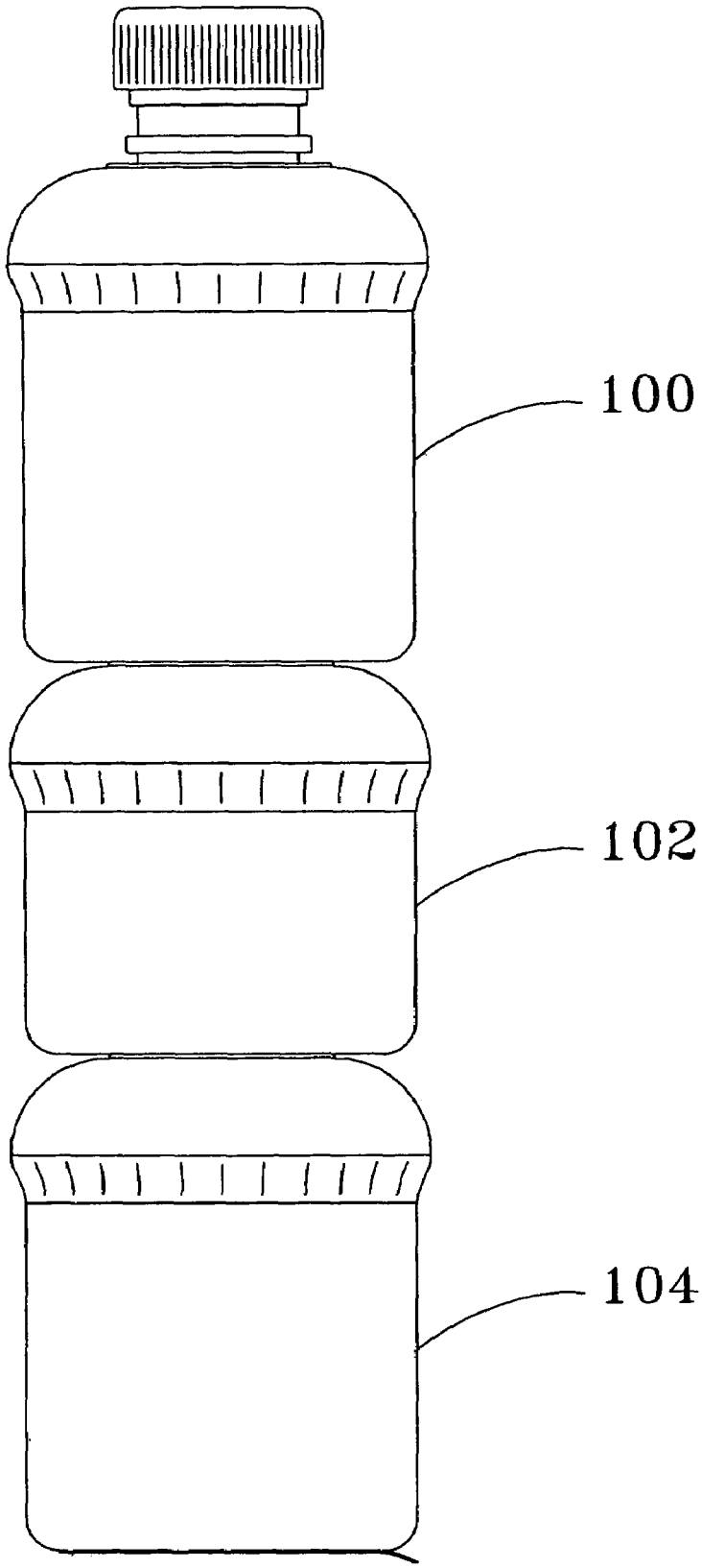
FIG. 12 is a plan view of a proposed stacking arrangement of the preferred embodiment beverage mixing container.

FIG. 12 illustrates a possible stacked arrangement of a first container 100, a second container 102 and a third container 104. All three containers may be of the preferred embodiment, the first alternate embodiment or the second alternate embodiment. From this illustration it can be seen that the volumetric sizing of the containers can be varied depending upon the contents.

The diameter of disk 52 is sized to exceed the diameter of all other openings into first alternate embodiment container 44, thereby eliminating the potential for disk 52 to ever leave first alternate embodiment container interior 47. In fabrication, disk 52 and second cylindrical wall 48 are extruded as one piece. Score 54 is then made in this single extrusion by the appropriate machine tool, whether a cutter head or drill/boring bit. The depth of score 54 and the height of opening nodule will vary with the material the bottle is fabricated from, the diameter of disk 52 and the desired "break away" pressure. The variance of which is well known and easily calculated by those skilled in the art.

Although score 54 is illustrated as continuous, it is well known in the art that a non-continuous score or a series of partial perforations would accomplish and enable the same break away function of disk 52.

Sanitary seal 34 may be a thin cellophane, aluminum, paper or plastic seal having opaque, translucent or clear characteristics. It must be non gas permeable to ensure sterility. Glue is the most likely method of mechanical attachment although heat sealing is also a viable method of attachment.

Bottom seal 32 and top seal 16 are generally more resilient than sanitary seal 34. Their methods of mechanical affixation are similar to that of sanitary seal 34, as are their materials of construction, however, it is common to use seals made of more than one material (I.E. foil or plastic backed paper) in circumstances that require the additional resiliency. Selection of these seals are based on the application and fluids contained.

First lock ring 10 and with second lock ring 38 are commonly found on medicine containers and constitute part of a mechanism known as a "child proof lock". Commonly, the mated engagement of these rings can be released by the displacement of these rings relative to each other along the plane of their central axis. This invention does not provide for such displacement and containers once joined, cannot be disengaged. This prevents decompression of gasket 8 and leakage of fluid.

While the description of this invention is directed toward use with beverages it's utilitarian function to allow mixing of fluids without spilling and without the need for additional funnels and containers is well recognized. It is well suited for any fluids and powders, or combinations thereof, that require mixing prior to use but where spillage or leakage is impractical. A non-exhaustive list of other known uses include salad dressings, paints, oils, automotive products, cooking supplies etc.

What is claimed is:

1. A fluid container adapted for leakproof connection with one or more substantially similar fluid containers, comprising:

a generally cylindrical body with a bottom and a tapered upper shoulder terminating in a wide mouth neck having external threads formed thereon;

a cap having internal threads formed thereon;

a lower recess formed by a cylindrical wall extending inward from said container bottom wherein said wall has internal threads formed thereon and adapted for threaded engagement with an upper wide mouth neck;

a substantially rigid removable disk mechanically affixed to said cylindrical wall wherein said removable disk is generally planar in configuration having an upper face and a lower face and further wherein said lower face has a hemispherical protrusion formed proximate to a periphery of said disk;

a sterile seal mechanically affixed atop said wide mouth neck; and a seal cutter formed on a bottom surface of said disk.

2. The fluid container of claim 1 further comprising: at least two toothed ramps wherein said toothed ramps are affixed on an outer surface of a first ring and on an inner surface of a second ring so as to form an interlocking mechanical system adapted to prevent the threaded disengagement of said neck from said lower recess.

3. The fluid container of claim 2 further comprising a compressible elastomeric gasket mechanically affixed to said shoulder.

4. The fluid container of claim 3 wherein said container body, said cylindrical wall, and said neck are all share a common longitudinal axis.

5. The fluid container of claim 4 further comprising a circular notch formed in said cylindrical wall at a location proximate to said disk.

* * * * *